United States Patent [19]

Haug

[11] Patent Number: 4,953,310

[45] Date of Patent: Sep. 4, 1990

[54] SHOCK ABSORBANT HEEL

[76] Inventor: Richard J. Haug, 19 Sweetbriar La., Hampton, N.H. 03842

[21] Appl. No.: 337,396

[22] Filed: Apr. 13, 1989

[51] Int. Cl.[5] ..... A43B 21/26

[52] U.S. Cl. ..... 36/38; 36/35 R

[58] Field of Search ..... 36/34 R, 35 R, 35 A, 36/35 B, 35 C, 36 R, 37, 38

[56] References Cited

U.S. PATENT DOCUMENTS

| | | | |
|---|---|---|---|
| 1,675,256 | 6/1928 | Crosthwatt | 36/38 |
| 1,977,777 | 10/1934 | Rhodes | 36/36 R |
| 2,159,943 | 5/1939 | Palley | 36/38 |
| 2,383,877 | 8/1945 | Miller | 36/38 |
| 2,417,127 | 3/1947 | Roberts | 36/35 R |
| 2,807,100 | 9/1957 | Windle | 36/35 R |
| 2,836,907 | 6/1958 | Windle | 36/38 |
| 3,043,024 | 7/1962 | Hang, Jr. | 36/36 R |
| 3,174,235 | 3/1965 | Johnston | 36/36 R |
| 3,822,709 | 7/1974 | Gruner | 36/34 R |

FOREIGN PATENT DOCUMENTS

| | | | |
|---|---|---|---|
| 2431420 | 1/1975 | Fed. Rep. of Germany | 36/38 |
| 501674 | 3/1939 | United Kingdom | 36/35 R |
| 2336 | 9/1957 | United Kingdom | 36/36 R |

*Primary Examiner*—Steven N. Meyers

*Attorney, Agent, or Firm*—Samuels, Gauthier & Stevens

[57] ABSTRACT

A plate is molded into the lift of a heel. Resilient material is interposed between the lower surface of the heel block and the lift. Primary and secondary posts pass through the plate in a moveable manner. The primary post is joined to a primary shaft received in the heel block. The upper end of the shaft is in engagement with a compressible material. The secondary post is received in a secondary shaft and adapted for movement therein. The dual post arrangement in combination with the plate prevents the lift from being torn from the heel block.

11 Claims, 3 Drawing Sheets

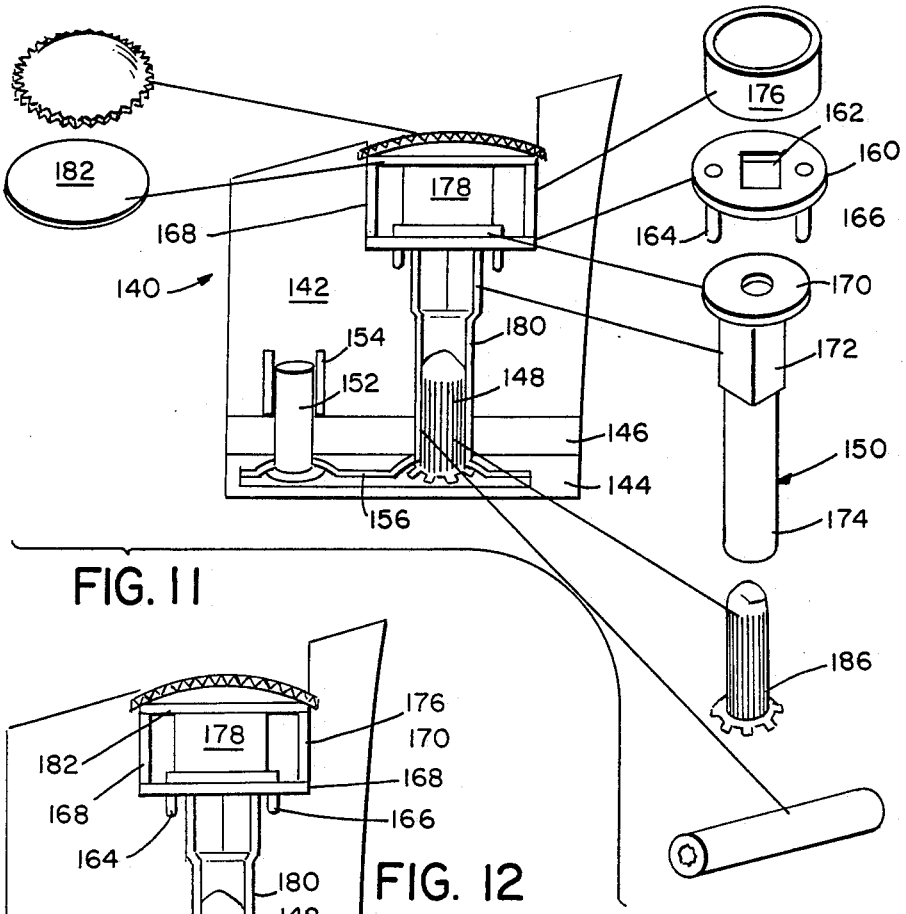
FIG. 11
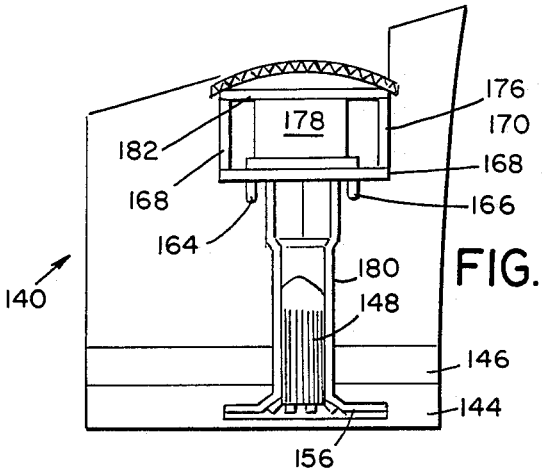
FIG. 12
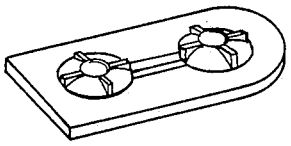
FIG. 17
FIG. 13
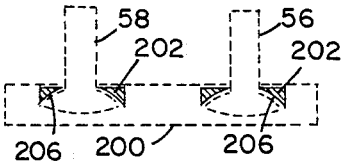
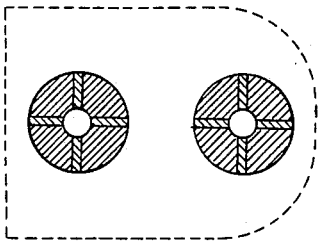
FIG. 14
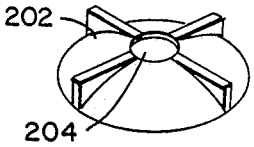
FIG. 15
FIG. 16
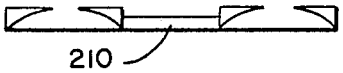

SHOCK ABSORBANT HEEL

BACKGROUND OF THE INVENTION

This invention relates to a cushioned heel construction adapted for use in elevated heels.

Presently, there are available a wide variety of shock absorbent heel constructions designed to minimize the shock forces incurred during walking by the wearer of the heel construction. See for example the references cited in my U.S. Pat. No. 3,043,024; and U.S. Pat. Nos. 3,174,235; and 4,680,876. These latter patents disclose constructions which have utilized springs, elastic compressible materials and/or pneumatic cylinders or the like and are undesirable because they are usually expensive to make and difficult to maintain over extended periods of use. Furthermore, presently available constructions are undesirable because they tend to weaken the strength of the heel to the point that the wearer has inadequate support.

It is necessary that heel constructions adapted to absorb the shock forces of walking provide the desired cushioning while at the same time have adequate strength so that they are able to endure the normal wear forces. In addition, such a heel construction should be made so that the lift portion which experiences the most wear is easily replaceable without the need to replace the entire cushioning construction. Furthermore, such heel constructions must be cosmetically acceptable so that they are readily marketable.

My prior invention produced these advantages. However, it was found that the torque acting on the post arrangement unnecessarily tended to degrade or tear the lift, particularly the upper portion of the lift.

SUMMARY OF THE INVENTION

In accordance with this invention, a shock absorbent heel construction is provided which absorbs forces to the heel when walking thereby reducing fatigue to the wearer. The heel of this invention is simple in construction so that it is relatively inexpensive to produce and has the desirable feature of permitting replacement of worn lift portions without the need for discarding the entire heel construction. Furthermore, the present invention is adapted for use both in relatively wide elevated heels and in thin heels in that it is capable of absorbing the shock of walking while at the same time preserves the strength of the heel so that it can be used over a time period at least as long as the normal wear period for conventional heels.

In accordance with this invention, in one embodiment, a heel is provided with a primary rearward bore which preferably extends through the entire vertical height of the heel and into which is inserted an elongated primary shaft construction. The bottom of this arrangement is molded into the lift portion and the top is adapted to cooperate with a force-absorbing structure. A secondary forward post-shaft construction cooperates with a forward bore and is adapted to permit vertical movement of the lift portion during walking. This secondary post-bore arrangement, per se, absorbs some of the torque which would normally be handled alone by the prior art post arrangement; and thus, extends the life of the same.

In a preferred embodiment, the bottom of the primary shaft construction cooperates with a plate also molded into the lift which plate is connected to the secondary post shaft construction. The primary and secondary shafts in cooperation with the plate are adapted for pivotal movement which allows the lift to absorb twisting forces which result during walking.

In a particularly preferred embodiment of the invention, the primary post-shaft construction is configured to prevent relative rotational movement between the post and the shaft.

In still another embodiment of the invention, particularly for thin heels, the primary post-shaft construction is used per se with means to prevent relative rotational movement between the post and the shaft.

BRIEF DESCRIPTION OF THE DRAWINGS

FIG. 11 is an exploded view of a still further embodiment of the invention; and FIG. 12 is a view of a modified heel of FIG. 11.

DESCRIPTION OF THE PREFERRED EMBODIMENT

Figure 1:
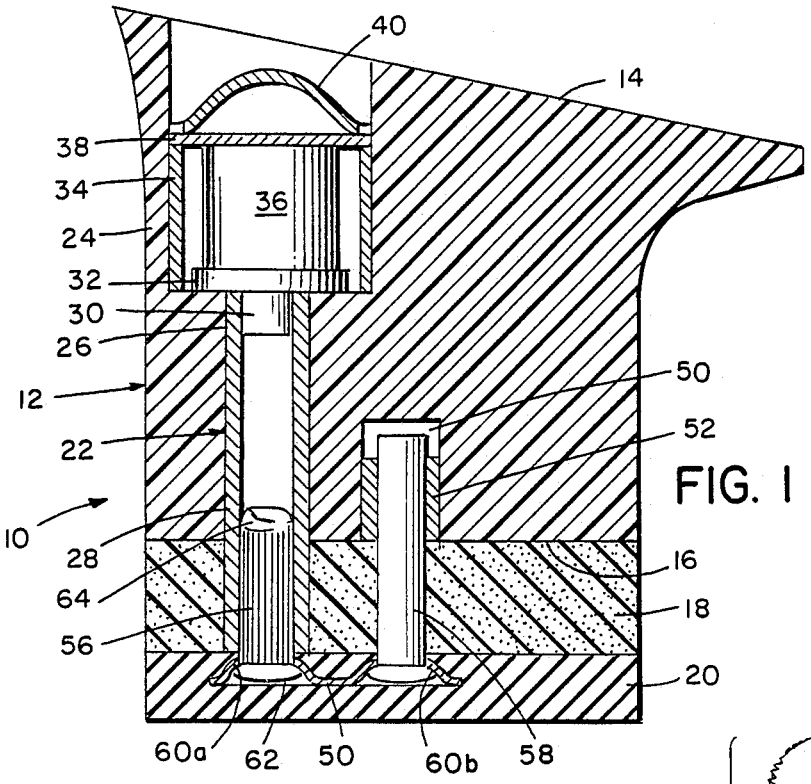
FIG. 1 is a perspective view of a heel embodying the invention with certain parts shown in exploded perspective.
Figure 2:
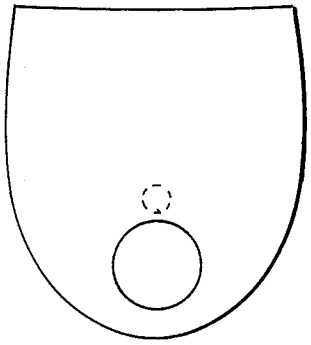
FIG. 2 is a top view of FIG. 1.
Figure 3:
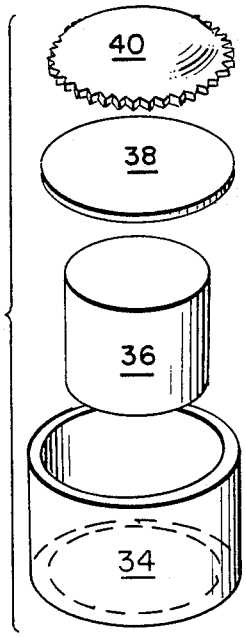
FIG. 3 is a perspective view of the compressible material and associated parts.

Referring to FIG. 1, a heel 10 embodying the invention comprises a heel block 12 having a top surface 14 and a lower surface 16. The top surface 14 is adapted to be secured to a shoe (not shown) by any conventional manner. To the bottom surface 16 is secured a resilient intermediate cushion 18, such as a microcellular foam, for example, a polyether open cell foam having a density of 20–25 $ft^3$, and to the cushion 18 is joined a lift 20. The cushion 18 is secured to the surface 16 by any suitable shoe adhesive.

The heel 10 has formed therein a primary bore 22 which comprises an upper enlarged section 24 and a lower elongated section 26. The primary bore extends through the heel block 12. A primary tube 28 is received in the primary bore 22, the lower edge of the primary tube contacting the upper surface of the lift 20. A shaft 30 is fixedly secured to the upper end of the primary tube 28, such as by crimping. The upper end of the shaft 30 has a washer 32 fixedly secured thereto. The tube 28, the shaft 30 and the washer 32 move together as a unit in the primary bore 22. The washer 32 rests on the floor of the upper enlarged portion 24 of the primary bore 22. The tube 28 is adapted to extend into the section 24 carrying the washer 32 with it.

The upper enlarged section 24 has received therein a cylindrical wall 34. A block of resilient compressible material 36, such as natural gum rubber, is placed within the cylindrical wall 34 and sits upon the washer 32. The material is 99.9% rubber; 0.02 to 0.08% silica; 0.02 to 0.08% sulfer; and 0.02 to 0.08% (proportion 2:1 to 1:2) of anti-oxidant—anti-ozonate (all % by weight). These additives enhance the properties of the rubber. A plate 38 covers the material 36 and is supported by the upper surfaces of the cylindrical wall 34. The block of resilient compressible material 36 is retained within the wall 34 by means of a serrated washer 40. The serrated washer 40 is press-fit into position such that the serrated edges extend into the wall of the bore section 24 thereby effecting the desired positioning of the compressible material. That is, after the washer has been press-fit into position and if there is no force on the heel then the upper surface of the material 3 contacts the plate 38 and rests on the washer 32. Thus, the outer surface of the compressible material 36 and the inner surface of the wall 34 define the limits of expansion of the compressible material (within the elastic limits of the material).

At least one secondary bore 50 extends into the heel block 12 but only through a portion of the vertical height of the heel block (although it may extend the entire length). A secondary tube 52 having a serrated outer wall is press-fit within the bore 50 for permanent positioning therein. This tube does not extend through the cushion 18. Its lower edge terminates at the lower surface 16 of the heel block.

Figure 4:
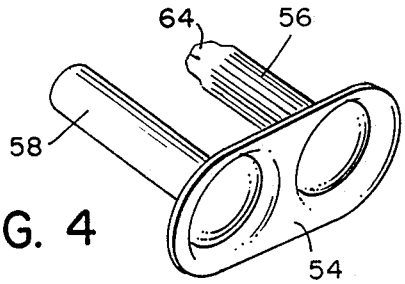
FIG. 4 is a perspective view of primary and secondary posts with the plate.
Figure 5:
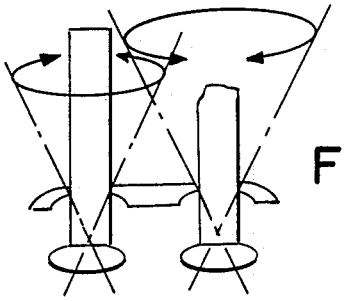
FIG. 5 is a front view of FIG. 4.

When the lift 20 is formed, in a conventional manner, a plate 54, shown most clearly in FIG. 4, together with a primary post 56 and a secondary post 58, all are retained together by molding them within the lift which is formed from lift materials well known in the art. The plate 54 comprises two apertures **60*a* and 60*b* through which the primary and secondary posts pass. The undersurfaces of the apertures are concave, circular surfaces. Lubriplate is applied to these prior to molding. The lower end of the posts 56 and 58 are sphere like. These sphere-like ends provide convex surfaces which seat respectively within the concave surfaces 62*a* and 62*b*. The outer diameter of the posts 56 and 58 are less than the inner diameter of the apertures 60*a* and 60*b*** to allow for relative pivotal and vertical movement of the posts.

Prior to molding a film covers the underside of the plate 50 so that the hot lift material when molded will not flow into the convex surfaces.

The primary post 56 has a serrated outer surface and is bent at its upper end 64. The secondary post 58 is smooth.

Referring to FIG. 4, the plate-primary and secondary post arrangement is shown as it would be placed in the mold for the lift.

The lift 20, with the plate 54, the primary post 56 and both the secondary post 58 is abutted to the cushion 18. The secondary post 58 slides into the tube 52. The lift 20 is secured the heel block 12 by the primary post 56 which is press-fit into the primary tube 28.

It is to be understood that in the art of shoe making heel blocks are manufactured to be able to accomodate varying wedge angles of the shoe ultimately made. Thus, the bottom of the block is usually cut. The lift is nailed to the cut surface and the lift trimmed. In the present invention, both the cushion 18 and the lift 20 after attachment are trimmed. Thus, the cushion 18 must be trimmable to ensure a smooth outer surface for both structural and cosmetic reasons.

During use, the heel construction of this invention operates as follows: Under the normal walking forces, the lift 20 is compressed toward heel block 12 thereby compressing resilient layer 18 causing post 56-primary tube 28-washer 32 to move upwardly. The washer 32 compresses the resilient material 36 against plate 38 which is immovable within the bore 24. The secondary post moves vertically in the tube 52. The plate 54 alleviates the torque forces on post 56-tube 28 because the torque forces on the lift 20, which would normally be transferred solely to the post 56-tube 28, are transferred by the plate 54 to the post 58 within tube 52. That is, if the heel construction were devoid of post 58 and plate 54, the torque forces normally encountered during walking would be absorbed entirely by post 58 and tube 28 and would result in tearing of the top lift area relatively quickly. Accordingly, it is important that these torque forces be alleviated or transmitted so that the lift 20 does not become degraded quickly.

Figure 6:
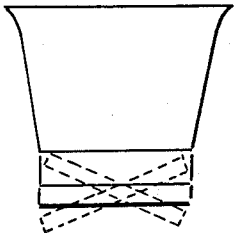
FIGS. 6, 7 and 8 are schematic illustrations of the relative motions between the lift and the heel block.
Figure 7:
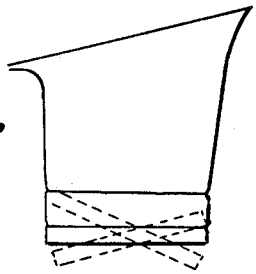
Figure 8:
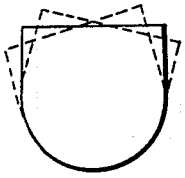

Referring to FIGS. 6, 7 and 8 the roll, pitch and yaw of the heel, with reference to the lift, are shown respectively. One or any combination of these motions may occur at any time. The actual degree of movement in any of these directions will depend upon the specific heel constructed, i.e. size of heel, compression of the resilient material, whether or not more than one secondary bore is used, if the resilient layer is used as a secondary absorbing force, etc.

When lift 20 wears down, the entire assembly comprising lift 20, post 56 and post 58 can be removed from the heel 12 by pulling the entire structure away from heel block 12. The resilient layer 18 may be replaced with a new resilient layer by adhering the new layer to the heel 12 and thereafter, a new lift structure is positioned into heel 12 as shown in FIG. 1.

Figure 9:
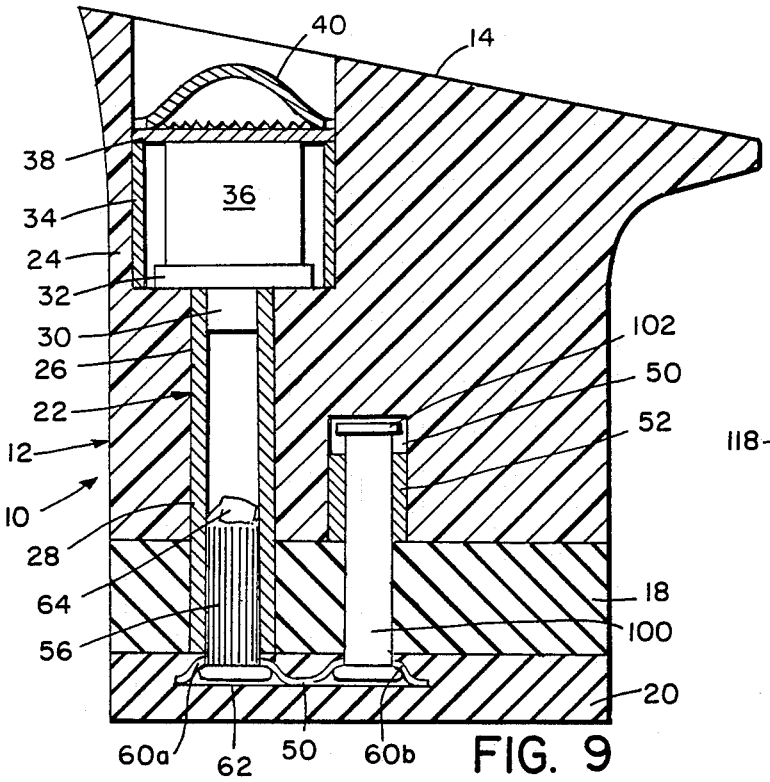
FIG. 9 is an alternative embodiment of the invention.

In an alternative embodiment, as shown in FIG. 9, the lift may be permanently secured to the heel and when worn, new lift material can be cemented over or otherwise attached to the worn area and trimmed in a regular shoe repair shop. In this alternative embodiment, when the lift is formed, a secondary post 100 includes an upper flared end 102.

The outer surface of resilient layer 18 is covered with a sheet of plastic tape, e.g. polyurethane in order to improve the cosmetic appearance of the heel. Alternatively, it may be coated, such as with a polyurethane adhesive.

Figure 10:
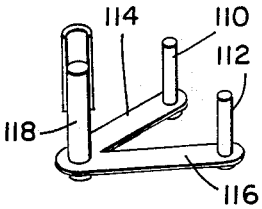
FIG. 10 is a still further embodiment of the invention.

Although my invention has been described with reference to a single, secondary bore post arrangement, it is within the scope of the invention that more than one secondary bore post arrangement can be used to alleviate the forces acting on the primary pin tube. As shown in FIG. 10, secondary posts 110 and 112 are each connected to plates 114 and 116 which in turn connects to the primary post 118.

In a further embodiment of the invention, a plurality of posts are used without plates, or three posts are used with only two joined by a plate.

In some heel constructions where it is expected the heel will experience unusual stress or torque, another embodiment is provided. This increased torque may be incurred either due to the type of use the heel undergoes; i.e., a waitress, or because the heel size becomes so small it is unable to incorporate a primary secondary post-plate arrangement.

In these situations, it is desirable to prevent relative rotation between the primary shaft and post. Referring to FIG. 11, a heel construction is shown generally at 140 and comprises heel block 142, lift 144, cushion 146 with a primary post 148 received in primary shaft 150. A secondary post 152 is received in a secondary shaft 154. A plate 156 connects the two. The assembly of the heel, posts, etc. are as described for the preferred embodiment. Shown in exploded view, the primary post 148 is broached and received in the mating shaft 150. This prevents relative rotational movement between the post and the shaft. A washer 160 characterized by a square aperture 162 and depending pins 164–166 is seated into the enlarged upper bore. The pins penetrate into the heel block material and this prevents the washer 160 from turning.

The primary shaft 150 includes a platform 170 formed on an upper square shaft portion 172 and a depending cylindrical shaft 174. The shaft 150 passes through the square aperture 162 which allows the shaft to move up and down without any twisting motion. A cylindrical wall 176 is inserted in the upper bore and sits on the washer 160. As with the preferred embodiment, a compressible material 178 rests on the platform 170. A plate 182 is received on the upper edges of the walls 168. A serrated washer 184 is pressed into place. Again, as with the preferred embodiment, this locks in the plate 182 and wall 176.

The post 148 is flanged and toothed at its lower end 186. When the lift is molded, the material flows into the gaps between the teeth and thus prevents turning.

For narrow heel constructions, i.e., spiked heels, needle heels, etc., where it is not possible to use the plate-secondary post arrangement, the primary post-shaft arrangement of FIG. 11 may be used per se as shown in FIG. 12.

Various embodiments of my invention have been shown which provide for a cushioned lift and which prevent tearing, degradation or separation of the lift from the heel block both for wide heels where a secondary post shaft plate combinations are used to transmit torque forces and a single primary post shaft combination which prevents relative rotational movement between the shaft and post to prevent degradation to the lift.

Other shock absorbing devices may be used in lieu of the block, such as springs, pneumatic devices, air bags or other dampers. The preferred embodiment has been described with reference to the block as the sole absorbant structure for the heel. That is, the cushion described plays no role, or a minimal role in absorbing forces, its primary function is to maintain the lift spaced apart from the bottom of the heel block and for appearance. However, a cushion can be selected which would function to assist in the absorption of forces. Other resilient materials for the block and cushion may be used as would be apparent to one skilled in the art with knowledge of this disclosure.

Having described my invention, what I now claim is:

1. A heel construction for shoes comprising a heel block having a bottom surface and a top surface and a lift, a primary bore extending through said bottom surface, an elongated load transmitting means extending from the upper portion of the bore and through the bottom of the heel block, at least one secondary bore extending from the bottom surface into the heel block, a secondary post cooperating with the secondary bore adapted to move within said bore, means to transmit torque secured in the lift and moveably connected to the load transmitted means and to the secondary post whereby the lift is adapted for relative pivotal and vertical movement with reference to the heel block.

2. the heel construction of claim 11 which comprises a resilient layer positioned between the heel block and the lift.

3. The heel construction of claim 2 wherein the means to transmit torque comprises a plate molded integrally into the lift and connected to the load transmitting means and the secondary post.

4. The heel construction of claim 1 wherein the load transmitting means comprises a shaft including an enlarged portion adjacent the compressible material, the shaft extending downwardly within said primary bore and cooperating with a post extending from the lift, the primary shaft and said post joined together to cooperate as a single member.

5. The heel construction of claim 4 wherein the shaft is tubular and the post is press fit into said tube.

6. The heel construction of claim 5 which includes: means to prevent relative rotational movement between the post and the shaft.

7. The heel construction of claim 1 wherein the enlarged portion of said primary bore houses a wall adapted to retain the block of compressible resilient material therein.

8. The heel construction of claim 1 wherein a tube is received in the secondary bore and the secondary post is adapted to slide freely in said tube.

9. The heel construction of claim 8 wherein the upper end of the secondary post is flared to limit its relative movement within the tube.

10. The heel construction of claim 1 which comprises more than one secondary bore/secondary post arrangement.

11. The heel construction of claim 10 wherein plates are connected between the secondary posts and the load transmitting means.

* * * * *

UNITED STATES PATENT AND TRADEMARK OFFICE

CERTIFICATE OF CORRECTION

PATENT NO. : 4,953,310

DATED : 4 September 1990

INVENTOR(S) : Richard J. Haug

It is certified that error appears in the above—identified patent and that said Letters Patent is hereby corrected as shown below:

In the drawings, Sheet 3 of 3, Figures 13-17 should be omitted.

Signed and Sealed this

Tenth Day of March, 1992

*Attest:*

HARRY F. MANBECK, JR.

*Attesting Officer*

*Commissioner of Patents and Trademarks*